US006390464B1

(12) United States Patent
Gutierrez et al.

(10) Patent No.: US 6,390,464 B1
(45) Date of Patent: May 21, 2002

(54) MEDIA HANDLING DEVICES AND MEDIA HANDLING METHODS

(76) Inventors: Hernan Gutierrez, Alameda 678 Colonia Alcaraz, Guadalajara, Jalisco (MX), 44280; Laurent A. Regimbal, 3024 N. Falstaff Pl.; Steven M. Johnson, 4363 N. Ballantyne La., both of Eagle, ID (US) 83616; Raul Ocampo, Manuel Daualos 690, Guadalajara, Jalisco (MX)

( * ) Notice: Subject to any disclaimer, the term of this patent is extended or adjusted under 35 U.S.C. 154(b) by 0 days.

(21) Appl. No.: 09/399,610

(22) Filed: Sep. 20, 1999

(51) Int. Cl.[7] ..... B65H 29/00

(52) U.S. Cl. ..... 271/184; 271/273; 271/303; 271/176; 271/902; 318/599

(58) Field of Search ..... 271/303, 902, 271/184, 185, 176, 273; 318/599

(56) References Cited

U.S. PATENT DOCUMENTS 4,486,012 A * 12/1984 Bock et al. ..... 271/176
4,804,175 A * 2/1989 Granduear ..... 271/176
4,825,248 A * 4/1989 Horijo et al. ..... 271/259
5,193,801 A * 3/1993 Coombs et al. ..... 271/293
5,797,687 A * 8/1998 Petersen et al. ..... 400/23
5,979,311 A * 11/1999 Kakurai et al. ..... 101/118
6,082,724 A * 7/2000 Kahlig et al. ..... 270/52.14
6,130,998 A * 10/2000 Ochiai ..... 271/184
6,132,352 A * 10/2000 Rider ..... 271/303
6,144,176 A * 11/2000 Quinlan ..... 318/599

* cited by examiner

*Primary Examiner*—H. Grant Skaggs

(57) ABSTRACT

The present invention relates to media handling devices and media handling methods. One aspect of the invention provides a media handling method including providing a media handling device having an initial media path; selectively moving a guide member using a motor intermediate a first position where the guide member is spaced from media within the initial media path and a second position where the guide member contacts the media within the initial media path; applying a control signal to the motor to control the moving; and modulating the control signal.

25 Claims, 5 Drawing Sheets

MEDIA HANDLING DEVICES AND MEDIA HANDLING METHODS

FIELD OF THE INVENTION

The present invention relates to media handling devices and media handling methods.

BACKGROUND OF THE INVENTION

Image forming devices, such as printers and copiers, have become increasingly sophisticated. Some image forming devices provide additional functions other than typical printing or document reproduction functions. Some conventional printers and other image formation systems include a plurality of device attachments or stations configured to handle such additional functions. More specifically, in addition to the provided image formation equipment, assemblies can be included for stapling documents, stacking documents, folding documents, etc.

Media handling devices are typically provided to direct media to proper document preparation stations. In some applications, handling functions of media are implemented to provide proper orientation or presentation of media to the various document preparation stations. An exemplary handling function is flipping the orientation of media during passage of the media from one station to another.

Accordingly, conventional paper handling systems have been developed to provide flipping and other media handling functions. One exemplary media handling device includes an input device configured to receive media and initially direct media within the media handling device. A set of rollers is typically positioned downstream of such input device. During entry of media within the media handling device, the rollers are provided in a receiving state wherein the rollers are separated by a fixed distance in order to receive the incoming media. Following entry of the media intermediate the separated rollers, a motor is actuated to draw one roller towards the other roller with the inputted media therebetween.

The movement of the roller is implemented using a direct current (DC) motor in some designs. In such arrangements, the DC motor operates to move the separated roller towards the other roller to contact the media. Thereafter, the plural rollers control subsequent movement of the media within the media handling device.

In conventional configurations, the DC motor drives the movable roller to a hard stop against the other roller. Such is implemented without the use of feedback control to indicate the position of the roller being moved. However, the hard stops have been observed to produce acoustic noise during operation of the media handling device. Such acoustic noise is undesirable in many environments.

Therefore, a need exists to provide improved media handling devices and methodologies to handle the movement of media.

SUMMARY OF THE INVENTION

According to one aspect of the invention, a media handling device comprises: a housing having an initial media path; a moveable guide member positioned to guide media within the initial media path; a motor configured to selectively move the guide member intermediate a first position where the guide member is spaced from the media within the initial media path and a second position where the guide member contacts the media within the initial media path; and a controller configured to apply a control signal to the motor to control the motor and corresponding movement of the guide member, the controller being further configured to modulate the control signal.

A second aspect of the invention provides a media handling device comprising: a housing having a first media path and a second media path; an input configured to provide media into the first media path; an output configured to output media from the second media path; a moveable guide member configured to direct the media from the first media path to the second media path to flip the media; a motor configured to move the guide member intermediate a first position where the guide member is spaced from the media within the initial media path and a second position where the guide member contacts the media within the initial media path; and a controller configured to apply a control signal to the motor to control the motor and corresponding movement of the guide member, the controller being further configured to modulate the control signal.

Another aspect of the invention provides a media handling method comprising: providing a media handling device having an initial media path; selectively moving a guide member using a motor intermediate a first position where the guide member is spaced from media within the initial media path and a second position where the guide member contacts the media within the initial media path; applying a control signal to the motor to control the moving; and modulating the control signal.

DESCRIPTION OF THE DRAWINGS

Preferred embodiments of the invention are described below with reference to the following accompanying drawings.

FIG. 10 is a graphical representation of operations of a motor of the media handling device.

DETAILED DESCRIPTION OF THE INVENTION

This disclosure of the invention is submitted in furtherance of the constitutional purposes of the U.S. Patent Laws "to promote the progress of science and useful arts" (Article 1, Section 8).

Figure 1:
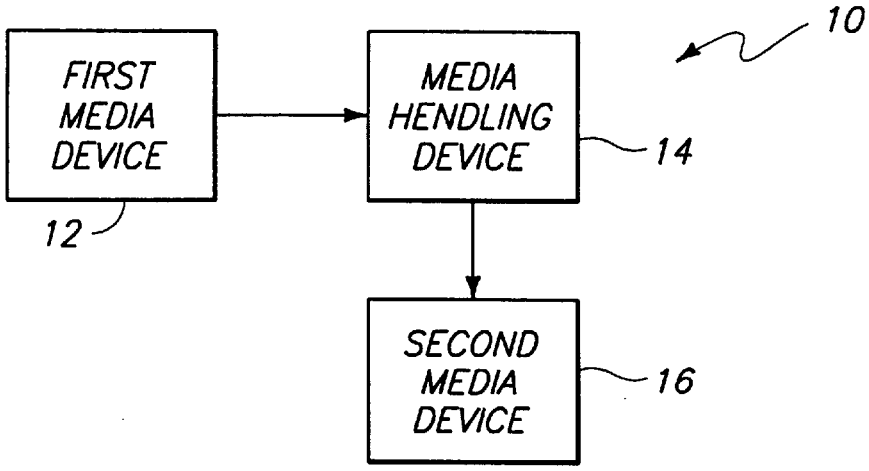
FIG. 1 is a functional block diagram of an exemplary media system according to one aspect of the present invention.

Referring to FIG. 1, an exemplary media system 10 is shown. The depicted media system 10 includes a first media device 12, a media handling device 14 and a second media device 16. In the illustrated configuration, devices 12, 14, 16 are implemented as separate units. In other arrangements according to the invention, devices 12, 14, 16 are implemented within a single housing forming a unitary device. Other configurations of media system 10 are possible.

Devices 12, 14, 16 are configured to provide different functions in the described media system 10. In one embodiment, media device 12 and media device 16 are configured to provide processing operations of the media.

For example, media device 12 may be an image forming device, such as a printer or copier, for providing images upon media. Second media device 16 can be configured to provide downstream processing operations of the printed media, such as stacking, stapling, etc.

Media handling device 14 is configured to receive media from first media device 12 and to apply such media to second media device 16 in the depicted arrangement. Media handling device 14 is configured to additionally provide media handling or manipulation operations in the described configuration. As detailed further below, media handling device 14 is configured to flip media received from media device 12 before application of such media to media device 16. Devices 12, 14, 16 are configured to provide other operations or functionalities in other configurations.

Figure 2:
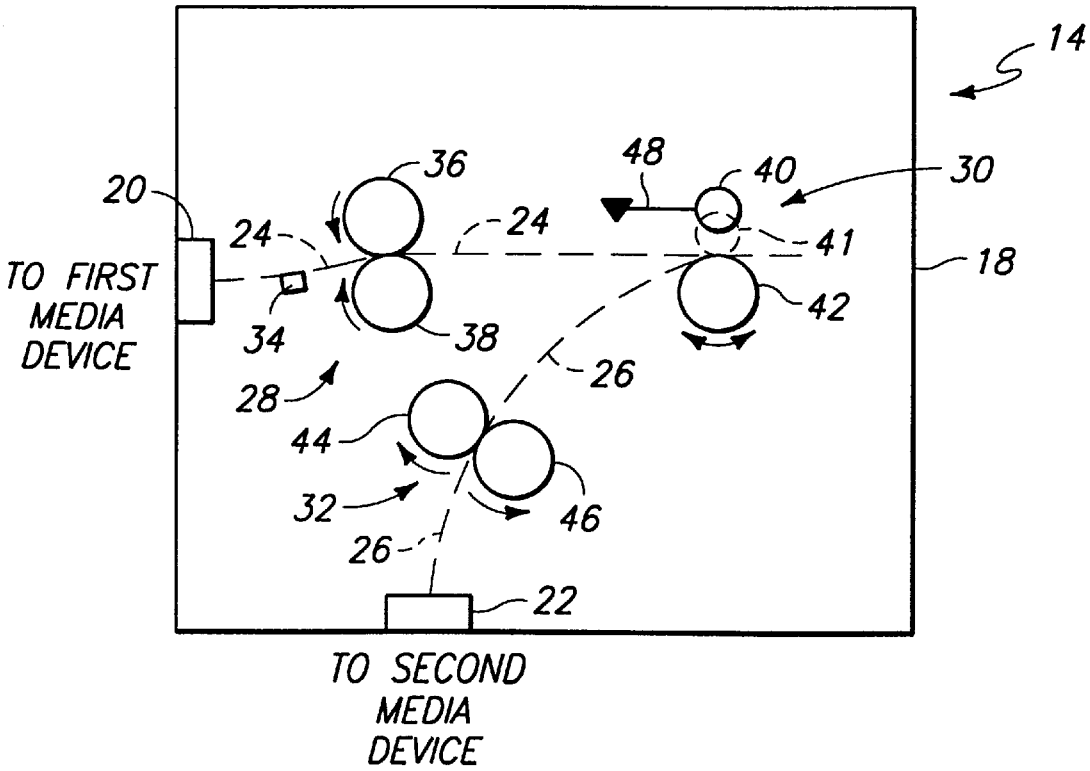
FIG. 2 is a functional representation of an exemplary media handling device of the media system.

Referring to FIG. 2, details of an exemplary configuration of media handling device 14 are shown. The illustrated media handling device 14 includes an outer housing 18. Housing 18 includes an input 20 and output 22 as shown. Input 20 and output 22 can comprise orifices within housing 18 operable to respectively permit ingress and egress of media with respect to housing 18. In the described arrangement, input 20 is positioned to receive media from media device 12 and output 22 is configured to output media to media device 16.

The depicted configuration of housing 18 includes a first media path 24 and a second media path 26 as illustrated. Media received from media device 12 via input 20 is guided to media path 24. More specifically, input 20 is arranged adjacent media path 24 to provide received media within media path 24. Output 22 is positioned to receive media from media path 26.

Media handling device 14 additionally includes plural guide assemblies 28, 30, 32 in the described embodiment. A sensor 34 is also provided within housing 18 of the illustrated media handling device 14. In the depicted configuration, individual guide assemblies 28, 30, 32 comprise plural guide members. For example, guide assembly 28 includes guide members 36, 38. Guide assembly 30 includes guide members 40, 42. Guide assembly 32 includes guide members 44, 46. Exemplary guide members include rollers although other configurations of such guide members are possible. Guide members 40, 42 of guide assembly 30 may be referred to as flipper switches which implement a flipping function of the media.

Guide assemblies 28, 30, 32 define media paths 24, 26 within housing 18. As depicted, guide assembly 28 defines a portion of media path 24 and guide assembly 32 defines a portion of media path 26. Sensor 34 is positioned adjacent media path 24 and is sensitive to the presence of media traveling along media path 24 (media is not shown in FIG. 2). Sensor 34 is configured to indicate the presence or absence of media at a corresponding location along media path 24. Although not shown, additional sensors can be provided along media paths 24, 26 to provide additional position information of media traveling along such media paths 24, 26.

As described in further detail below, guide assembly 30 is configured to receive media from first media path 24 and to guide such media to second media path 26 to flip the media. In the described configuration, guide member 40 is a moveable guide member and guide member 42 is a stationary guide member.

In the described configuration, a common motor (not shown) is utilized to drive guide members 36, 38, 42. More specifically, guide members 36, 38, 42 are driven at a speed equal to the speed of media received from media device 12 in one embodiment. Guide member 40 is free to rotate in the described configuration.

Another motor (not shown in FIG. 2) is configured to move guide member 40 intermediate a first position (as illustrated in FIG. 2) where guide member 40 is spaced from media within media path 24 and a second position 41 (illustrated in phantom in FIG. 2) where guide member 40 contacts media within media path 24.

Guide member 42 is positioned adjacent the second position 41 of moveable guide member 40 to contact media in media path 24. More specifically, in such second position 41, guide member 40 is adjacent guide member 42 with the media sandwiched therebetween. In the illustrated configuration, if no media is present within media paths 24, 26, guide member 40 in second position 41 contacts guide member 42.

Guides 44, 46 are driven by a motor (not shown) at a speed which matches a media speed of media device 16 in the described arrangement. Such facilitates transportation of media from media handling device 14 to media device 16.

As described above, guide assembly 28 is an input guide configured to pass media received from input 20 along media path 24 in the described configuration. Guide assembly 32 provides an output guide configured to pass media along media path 26 to output 22.

Guide assembly 30 is configured to direct media within media path 24 to media path 26. Directing media from media path 24 to media path 26 operates to flip the media. A flap 48 is utilized to assist with the direction of media from media path 24 to media path 26 in the depicted configuration. Operations of flap 48 and guide assembly 30 are described in detail below with reference to FIG. 3–FIG. 7.

Figure 3:
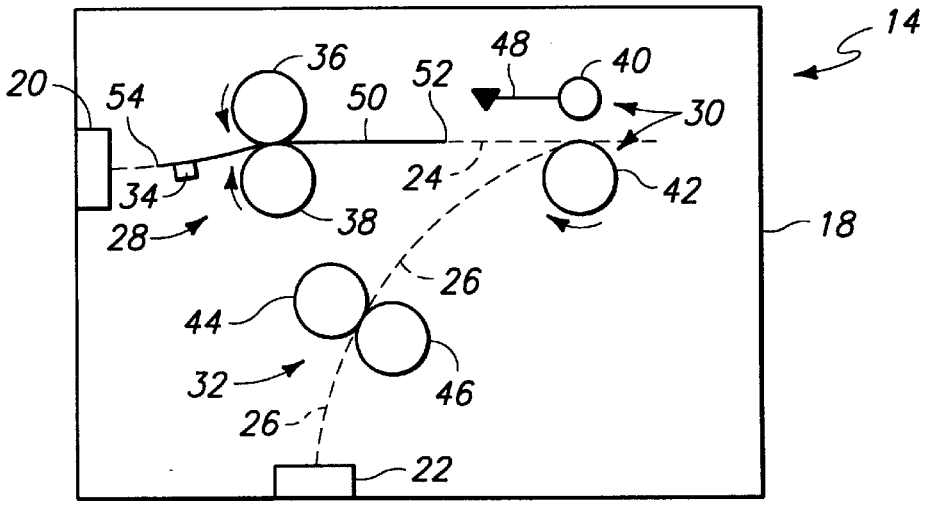
FIG. 3–FIG. 7 are functional representations of exemplary operations of the media handling device.

Referring to FIG. 3, media 50 is illustrated traveling along first media path 24 (shown in phantom) responsive to rotation of guide members 36, 38. Media 50 can comprise paper, envelopes, transparencies, etc. The depicted media 50 comprises a sheet of paper having edges 52, 54. During travel along media path 24, edge 52 is a leading edge and edge 54 is a trailing edge.

FIG. 3 illustrates the initial movement of media 50 within media handling device 14. Sensor 34 initially detects the presence of media 50 following passage of edge 52 of media 50 through input 20 and over sensor 34. Guide member 40 is provided in the first or initial position as shown during reception of media 50 within media handling device 14.

Figure 4:
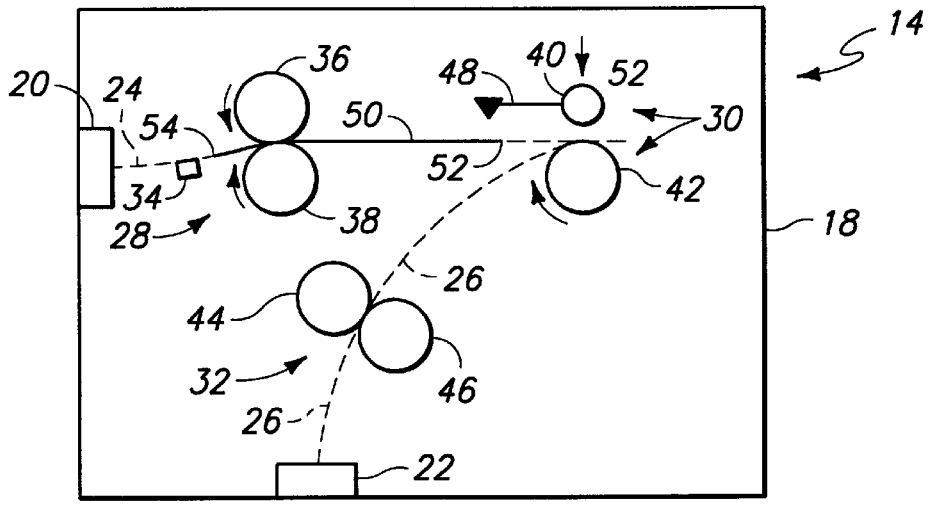

Referring to FIG. 4, guide member 40 is illustrated being lowered towards guide 42. Responsive to detection of leading edge 52 by sensor 34, a motor (shown in FIG. 8) is controlled to lower guide member 40 towards the second position adjacent guide member 42. The rotational speed of guides 36, 38 can be increased following detection of media 50 by sensor 34.

Figure 5:
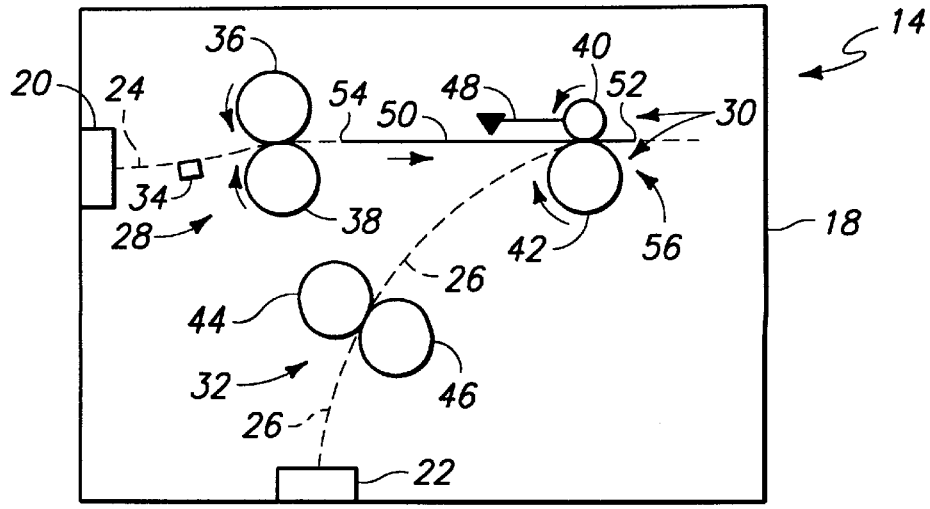

Referring to FIG. 5, guide member 40 is illustrated in the second position (position 41 of FIG. 2) adjacent guide member 42. Guide assembly 30 defines a nip 56 to receive media 50 during positioning of moveable guide member 40 in position 41. Following the passage of edge 54 of media 50 out of guide assembly 28, flap 48 may be driven by a motor (not shown) in a downward direction towards media 50. Although not shown, a sensor may be provided on a downstream side of guide assembly 28 to monitor the exit of edge 54 from guide assembly 28.

Figure 6:
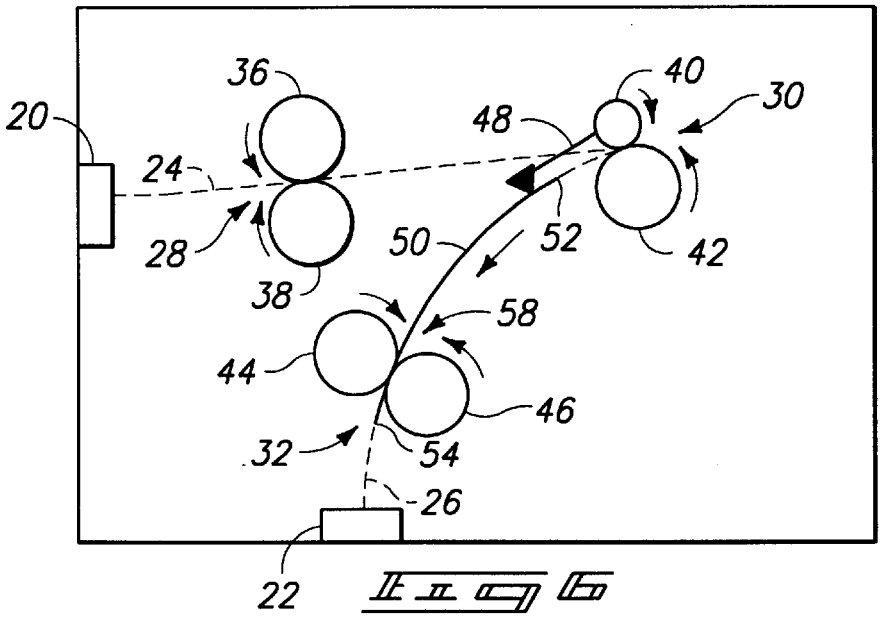

Referring to FIG. 6, such downward movement of flap 48 guides media 50 to media path 26 and guide assembly 32.

Following the appropriate positioning of media 50 using flap 48, the direction of rotation of guide member 42 is reversed to direct media 50 towards guide assembly 32. The direction of rotation of guide member 42 is reversed after a sufficient stabilization period of time following the reception of media 50 along media path 24 within nip 56. Guide member 42 directs media 50 into a nip 58 defined by guide members 44, 46 of guide assembly 32.

Figure 7:
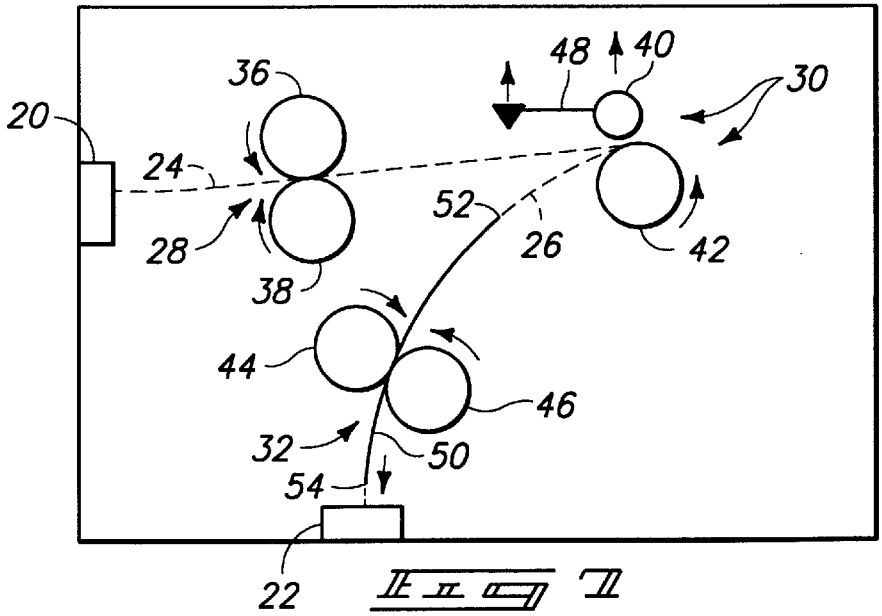

Referring to FIG. 7, guide members 44, 46 are driven to pass media 50 along media path 26 towards output 22. Media 50 is passed to media device 16 (FIG. 1) following passage through output 22. The direction of media 50 from input 20 along media paths 24, 26 to output 22 flips the orientation of media 50.

Following passage of media to guide assembly 32, guide member 40 is raised towards the initial position of guide member 40 shown in FIG. 3. Additionally, flap 48 is raised along with guide member 40 to a position for receiving subsequent media along media path 24.

Figure 8:
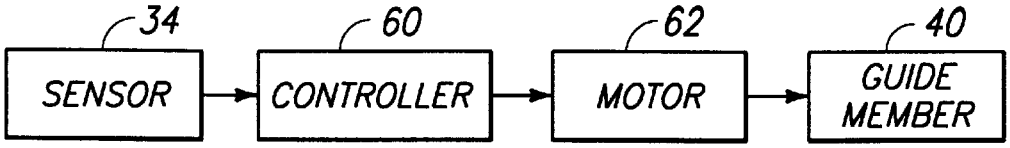
FIG. 8 is a functional block diagram of components of an exemplary media handling device.

Referring to FIG. 8, a controller 60 and a motor 62 are illustrated. In particular, controller 60 is coupled with sensor 34 and motor 62. Motor 62 is additionally coupled with guide member 40. In the depicted configuration, controller 60 comprises a microcontroller configured to execute firmware for controlling the operations of media handling device 14. In the depicted configuration, motor 62 comprises a direct current (DC) motor. Motor 62 is driven by current controlled responsive to a control signal received from controller 60.

As described further below, operations of controller 60 are provided for controlling guide member 40 using motor 62. More specifically, controller 60 receives position information of media 50 from sensor 34. Responsive to such position information, controller 60 can regulate motor 62 to control the movement of moveable guide member 40 intermediate the first position and the second position.

It is desired to reduce the acoustic noise of media handling device 14 during the movement of guide member 40 intermediate such first and second positions. Accordingly, controller 60 is configured to apply a control signal as described below to motor 62 to control the operation thereof and corresponding movement of guide member 40.

In accordance with certain aspects of the invention, controller 60 is configured to modulate the control signal applied to motor 62. As described further below, controller 60 is configured in one embodiment to selectively pulse width modulate the control signal applied to motor 62. Controller 60 is configured to modulate the control signal during movement of guide member 40 in the described embodiment. At other times, controller 60 provides a substantially constant or steady state control signal to motor 62.

In one embodiment, the application of the substantially constant control signal to motor 62 is responsive to guide member 40 being in one of the first position and the second position. Controller 60 is configured to detect a hard stop of moveable guide member 40 at one of the first position and the second position. Controller 60 then provides the constant control signal to motor 62 after detection of the hard stop.

Motor 62 applies a holding torque to guide member 40 responsive to reception of the constant control signal. Such is utilized to increase a normal force within nip 56 of guide assembly 30 to assist with the movement of media 50 during the positioning of guide member 40 in the second position. Additionally, if the modulated control signal fails to fully move guide member 40 to one of the first position or the second position, the subsequent constant control signal can urge or fully move guide member 40 to the appropriate first position or second position.

According to another aspect, controller 60 is configured to time the modulation of the control signal and to provide the substantially constant control signal after timing a predefined length of time. Such length of time is typically chosen to be of sufficient duration for guide member 40 to fully travel the distance intermediate the first position and the second position. Other control schemes utilizing a modulated control signal to control motor 62 are possible.

Different modulation schemes were utilized in experiments to tune the control of motor 62. Table A below illustrates exemplary modulation schemes and corresponding operations of media handling device 14.

TABLE 1

| | Downwards total time | Downwards speed at contact | Upwards total time | Upwards max speed at contact |
|---|---|---|---|---|
| 25% duty cycle | 125 ms | 13.87 Hz | | |
| 50% duty cycle | 90 ms | 24.5 Hz | 108 ms | 9.91 Hz |
| 75% duty cycle | 56 ms | 31.54 Hz | 65.2 ms | 17.95 Hz |
| Full current | 49.4 ms | 37.16 Hz | 52.8 ms | 28.12 Hz |

Following experimentation, controller 60 is configured in one aspect to provide the following operation for controlling motor 62. During movement of guide member 40 in a downward direction from the first position to the second position, controller 60 is configured to use a 25% duty cycle (5 ms timing) for approximately 150 ms. Following the timing of the predefined length of time (e.g., 150 ms), controller 60 applies a constant control signal to motor 62 to provide full current within motor 62 for application of the holding torque (increased normal force applied to media) during movement of media 50 out of guide assembly 30 to media path 26. Such constant control signal also assures movement of guide member 40 into the second position.

Following the passage of media 50 to guide assembly 32, guide member 40 is returned to the first position. During upwards movement from the second position to the first position of moveable guide member 40, the control signal is modulated by controller 60 using a 50% duty cycle for approximately 150 ms. Following the timing of 150 ms, 100 ms of a constant control signal is applied to motor 62 to implement full current operation thereof. Such is utilized in one aspect to assure proper return of guide member 40 into the first position.

Figure 9:
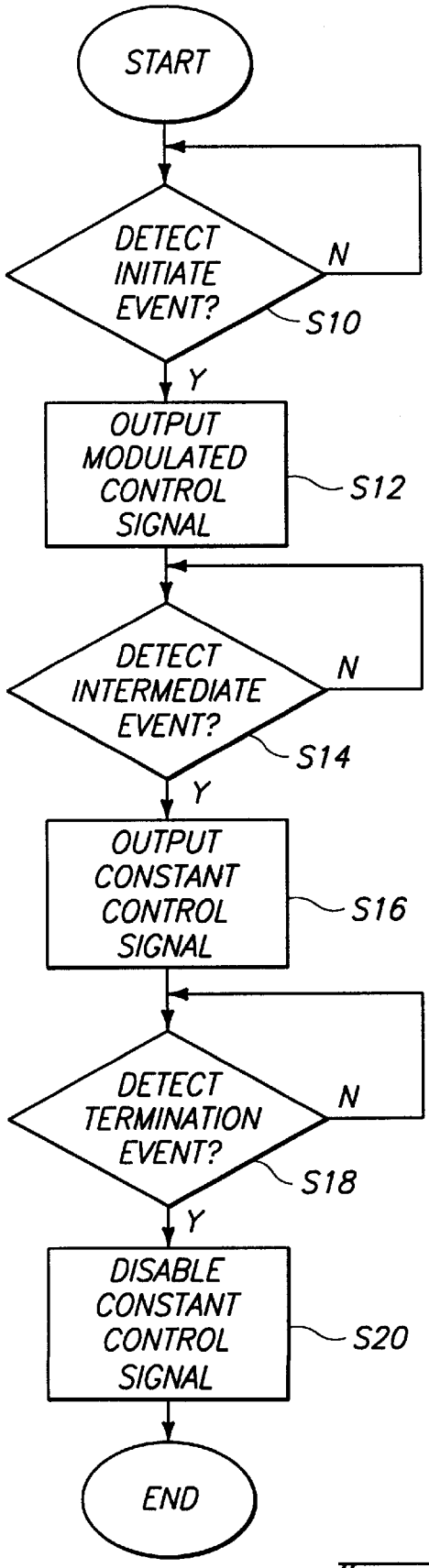
FIG. 9 is a flow chart which illustrates exemplary operations of the media handling device.
Figure 11:
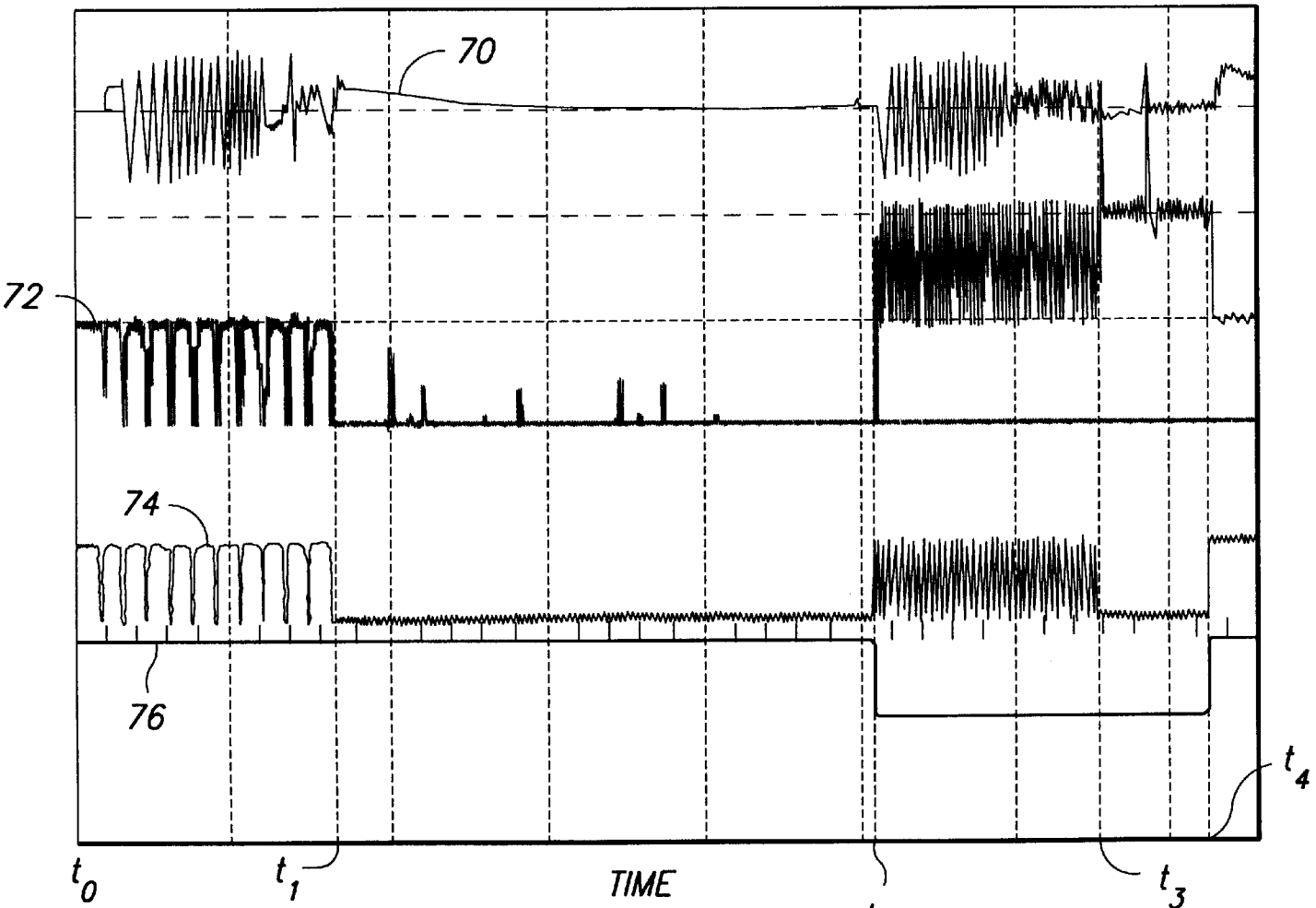

Referring to FIG. 9, a flow chart illustrates an exemplary method for controller 60 to control the movement of guide member 40 from the first position to the second position and vice versa. The method is implemented as executable code within the firmware of media handling device 14 according to one aspect. Alternatively, such methodology can be implemented within hardware in another configuration.

For movement of guide member 40 from the first position to the second position, controller 60 determines at step S10 whether an initiate event has occurred. An exemplary initiate event is the detection of media within media handling device 14. Sensor 34 is utilized to indicate such presence of media in the described embodiment. Controller 60 idles at step S10 until media is detected.

Thereafter, controller 60 proceeds to step S12 following the detection of the initiate event. At step S12, controller 60 issues or outputs a modulated control signal to motor 62. The control signal may be modulated according to one of the exemplary schemes described above.

Controller 60 then proceeds to step S14 to determine whether an intermediate event has been detected. In one aspect, controller 60 is configured to time a predefined time period comprising the intermediate event. Step S14 is utilized in such a configuration to apply the modulated control signal to motor 62 for the predefined time period. The intermediate event comprises a hard stop detection of guide member 40 in the second position according to another aspect. Controller 60 proceeds to step S16 responsive to the detection of an intermediate event.

At step S16, controller 60 outputs the constant control signal to motor 62. Application of the constant control signal results in the application of a holding torque of guide member 40 to media 50 and guide member 42.

Thereafter, controller 60 proceeds to step S18 to monitor for the presence of a termination event. During application of the constant control signal with guide member 40 in the second position, an appropriate detection event can be an indication from a sensor that the media has been moved from guide assembly 30. Another exemplary termination event is a timer (e.g., controller 60) counting a predefined time period.

Following detection of the termination event with guide member 40 in the second position, controller 60 proceeds to step S20 to de-assert the constant control signal to idle motor 62.

Thereafter, controller 60 can re-execute the depicted method of the flow chart of FIG. 9 to control the movement of guide member 40 from the second position back to the first position. The following describes execution of the depicted flow chart during movement of guide member 40 from the second position to the first position.

Controller 60 determines at step S10 whether an initiate event has occurred. The initiate event is the passage of media from guide assembly 30 to guide assembly 32 according to one aspect. Controller 60 idles at step S10 until the initiate event is detected.

Thereafter, controller 60 proceeds to step S12 following the detection of the initiate event. At step S12, controller 60 issues or outputs a modulated control signal to motor 62. The control signal may be modulated according to one of the exemplary schemes described above for providing upward movement of guide member 40 to return to the first position.

Controller 60 then proceeds to step S14 to determine whether an intermediate event has been detected. In one aspect, controller 60 is configured to time a predefined time period comprising the intermediate event. Step S14 is utilized in such a configuration to provide the application of the modulated control signal to motor 62 for the predefined time period. The intermediate event comprises a hard stop detection of guide member 40 in the first position according to another aspect. Controller 60 then proceeds to step S16 responsive to the detection of an intermediate event.

At step S16, controller 60 outputs the constant control signal to motor 62. The constant control signal can operate to kick or urge guide member 40 fully into the desired first position.

Thereafter, controller 60 proceeds to step S18 to monitor for the presence of a termination event. During application of the constant control signal with guide member 40 in the first position, an exemplary termination event is the timing of a predefined period of time (e.g., 100 ms). Other termination events are possible.

Following detection of the termination event with guide member 40 in the first position, controller 60 proceeds to step S20 to de-assert the constant control signal to idle motor 62.

Thereafter, controller 60 returns to step S10 in one configuration to await the detection of another initiate event (e.g., reception of new media) and to execute the depicted flow chart methodology again to provide movement of guide member 40 from the first position to the second position. The depicted flow chart is repeated during operation of media handling device 14 to continuously flip media.

Referring to FIG. 10, a timing diagram illustrates various operations of media handling device 14. Time increases from left to right in the depicted timing diagram. Plural lines are illustrated in FIG. 10. Line 70 illustrates the movement of motor 62 during the operation of media handling device 14. Line 72 illustrates current within motor 62 during such operations. Line 74 illustrates an enable control signal issued by controller 60 to control the current within motor 62. Line 76 illustrates a direction control signal of controller 62 to control motor 62 to control the direction of movement of guide member 40 intermediate the first and second positions. Guide member 40 is moved downward responsive to control signal 76 being asserted. Guide member 40 is moved upward responsive to control signal 76 being de-asserted.

The timing diagram is illustrated initially with guide member 40 in the first position. At time $t_0$, an initiate event is detected by controller 60 of media handling device 14. Such results in the application of a modulated control signal from controller 60 to motor 62 as represented by line 74. At time $t_1$, an intermediate event is detected (e.g., a predefined length of time has been timed) and the modulated control signal of line 74 is de-asserted.

Thereafter, application of a constant control signal as shown by line 74 provides a full current holding torque of motor 62 applied in a downward direction to urge guide member 40 fully to the second position.

At time $t_2$, a termination event occurs (e.g., media has left guide assembly 30 for travel along the second media path 26). In the described configuration, controller 60 thereafter re-executes the method of the flow chart and operates to again output a modulated control signal corresponding to line 74 to move guide member 40 upward towards the first position. The reader will note that signal 76 is de-asserted at time $t_2$ to provide upward movement to guide member 40.

The modulated control signal represented by line 74 is outputted for a predefined length of time. Following the timing of the predefined length of time at time $t_3$, a constant control signal is issued again by controller 60 as represented by line 74 to urge guide member 40 into the first position. Controller 60 times the application of the second constant control signal as represented by line 74 until a time $t_4$.

Such timing of the predefined length of time corresponds to a termination event. Thereafter, controller 60 awaits the reception of subsequent media or other appropriate initiate event wherein the control signals may be issued again to motor 62.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A media handling device comprising:

a housing having an initial media path;

a moveable guide member positioned to guide media within the initial media path;

a motor configured to selectively move the guide member intermediate a first position where the guide member is spaced from the media within the initial media path and a second position where the guide member contacts the media within the initial media path; and a controller configured to apply a control signal to the motor to control the motor and corresponding movement of the guide member, the controller being further configured to modulate the control signal at a first moment in time and to provide the control signal comprising a substantially constant control signal at a second moment in time.

2. The device according to claim 1 wherein the controller is configured to pulse width modulate the control signal.

3. The device according to claim 1 wherein the controller is configured to modulate the control signal during movement of the guide member.

4. The device according to claim 1 wherein the controller is configured to provide the substantially constant control signal responsive to the guide member being in one of the first position and the second position and the motor is configured to apply a holding torque to the guide member responsive to the substantially constant control signal.

5. The device according to claim 1 wherein the controller is configured to time the modulation of the control signal and to provide the substantially constant control signal to the motor after timing a predefined length of time.

6. The device according to claim 1 wherein the controller is configured to provide the substantially constant control signal to the motor after a hard stop of the guide member.

7. The device according to claim 1 wherein the housing defines another media path, and the guide member is configured to selectively direct the media within the initial media path to the another media path to flip the media.

8. A media handling device comprising:

a housing having a first media path and a second media path;

an input configured to provide media into the first media path;

an output configured to output media from the second media path;

a moveable guide member configured to direct the media from the first media path to the second media path to flip the media;

a motor configured to move the guide member intermediate a first position where the guide member is spaced from the media within the initial media path and a second position where the guide member contacts the media within the initial media path; and a controller configured to apply a control signal to the motor to control the motor and corresponding movement of the guide member, the controller being further configured to modulate the control signal at a first moment in time and to provide the control signal comprising a substantially constant control signal at a second moment in time.

9. The device according to claim 8 wherein the controller is configured to pulse width modulate the control signal.

10. The device according to claim 8 wherein the controller is configured to modulate the control signal during movement of the guide member.

11. The device according to claim 8 wherein the controller is configured to provide the substantially constant control signal responsive to the guide member being in one of the first position and the second position and the motor is configured to apply a holding torque to the guide member responsive to the constant control signal.

12. The device according to claim 8 wherein the controller is configured to time the modulation of the control signal and to provide the substantially constant control signal to the motor after timing a predefined length of time.

13. The device according to claim 8 wherein the controller is configured to provide the substantially constant control signal to the motor after a hard stop of the guide member.

14. A media handling method comprising:

providing a media handling device having an initial media path;

selectively moving a guide member using a motor intermediate a first position where the guide member is spaced from media within the initial media path and a second position where the guide member contacts the media within the initial media path; and applying a control signal to the motor to control the moving, the applying comprising applying the control signal comprising a modulated signal at a first moment in time and applying the control signal comprising a substantially constant signal at a second moment in time.

15. The method according to claim 14 wherein the applying the control signal comprising the modulated signal comprises applying the control signal comprising a pulse width modulated signal.

16. The method according to claim 14 wherein the applying comprises applying the modulated signal during the moving.

17. The method according to claim 14 wherein the applying comprises applying the substantially constant control signal to the motor during placement of the guide member within at least one of the first position and the second position.

18. The method according to claim 14 further comprising timing the applying the modulated signal, and wherein the applying comprises applying the substantially constant control signal to the motor after timing a predefined length of time.

19. The method according to claim 14 wherein the applying comprises applying the substantially constant control signal after a hard stop of the guide member.

20. The method according to claim 14 wherein the providing comprises providing the media handling device having another media path and further comprising guiding the media within the initial media path to the another media path to flip the media.

21. A media handling device comprising:

a housing having an initial media path;

a moveable guide member positioned to guide media within the initial media path;

a motor configured to selectively move the guide member intermediate a first position where the guide member is spaced from the media within the initial media path and a second position where the guide member contacts the media within the initial media path; and a controller configured to apply a control signal to the motor to control the motor and corresponding movement of the guide member, the controller being further configured to modulate the control signal and to provide a substantially constant control signal responsive to the guide member being in one of the first position and the second position and the motor is configured to apply a holding torque to the guide member responsive to the control signal.

22. A media handling device comprising:

a housing having an initial media path;

a moveable guide member positioned to guide media within the initial media path;

a motor configured to selectively move the guide member intermediate a first position where the guide member is spaced from the media within the initial media path and a second position where the guide member contacts the media within the initial media path; and a controller configured to apply a control signal to the motor to control the motor and corresponding movement of the guide member, the controller being further configured to modulate the control signal and to time the modulation of the control signal and to provide a substantially constant control signal to the motor after timing a predefined length of time.

23. A media handling device comprising:

a housing having a first media path and a second media path;

an input configured to provide media into the first media path;

an output configured to output media from the second media path;

a moveable guide member configured to direct the media from the first media path to the second media path to flip the media;

a motor configured to move the guide member intermediate a first position where the guide member is spaced from the media within the initial media path and a second position where the guide member contacts the media within the initial media path; and a controller configured to apply a control signal to the motor to control the motor and corresponding movement of the guide member, the controller being further configured to modulate the control signal and to provide a substantially constant control signal responsive to the guide member being in one of the first position and the second position and the motor is configured to apply a holding torque to the guide member responsive to the constant control signal.

24. A media handling device comprising:

a housing having a first media path and a second media path;

an input configured to provide media into the first media path;

an output configured to output media from the second media path;

a moveable guide member configured to direct the media from the first media path to the second media path to flip the media;

a motor configured to move the guide member intermediate a first position where the guide member is spaced from the media within the initial media path and a second position where the guide member contacts the media within the initial media path; and a controller configured to apply a control signal to the motor to control the motor and corresponding movement of the guide member, the controller being further configured to modulate the control signal and to time the modulation of the control signal and to provide a substantially constant control signal to the motor after timing a predefined length of time.

25. A media handling method comprising:

providing a media handling device having an initial media path;

selectively moving a guide member using a motor intermediate a first position where the guide member is spaced from media within the initial media path and a second position where the guide member contacts the media within the initial media path;

applying a control signal to the motor to control the moving;

modulating the control signal;

timing the modulation; and applying a substantially constant control signal to the motor after the timing.

* * * * *